US010640353B2

(12) United States Patent
Kole

(10) Patent No.: US 10,640,353 B2
(45) Date of Patent: May 5, 2020

(54) BOTTLE OPENER AND STABILIZER

(71) Applicant: John W. Kole, Fairfield, OH (US)

(72) Inventor: John W. Kole, Fairfield, OH (US)

( * ) Notice: Subject to any disclaimer, the term of this patent is extended or adjusted under 35 U.S.C. 154(b) by 123 days.

(21) Appl. No.: 16/018,693

(22) Filed: Jun. 26, 2018

(65) Prior Publication Data

US 2019/0002261 A1 Jan. 3, 2019

Related U.S. Application Data

(60) Provisional application No. 62/526,163, filed on Jun. 28, 2017.

(51) Int. Cl.

| | |
|---|---|
| ***B67B 7/44*** | (2006.01) |
| ***B65D 23/10*** | (2006.01) |
| ***B67B 7/18*** | (2006.01) |

(52) U.S. Cl.

CPC ..... *B67B 7/44* (2013.01); *B65D 23/104* (2013.01); *B67B 7/18* (2013.01)

(58) Field of Classification Search

CPC ..... B67B 7/44; B67B 7/18; B65D 23/104; B65D 23/04

USPC ..... 81/3.09

See application file for complete search history.

(56) References Cited

U.S. PATENT DOCUMENTS

| | | | | |
|---|---|---|---|---|
| 4,667,359 A * | 5/1987 | Polotti | A47G 23/0241 | 215/390 |
| 4,896,913 A * | 1/1990 | Kennedy | B65D 23/106 | 215/390 |
| 5,897,150 A * | 4/1999 | Rubini | B65D 23/106 | 215/396 |
| D662,383 S * | 6/2012 | Cizek | D8/40 | |

* cited by examiner

*Primary Examiner* — Hadi Shakeri

(57) ABSTRACT

A dual bottle opener and stabilizer is provided comprising a single manufactured unit that forms three individual sections, wherein the first section comprises a handle, the second section configured to engage a bottle cap of a bottle for removing and holding the bottle cap, and a third section for placing over a bottle neck and engaging a bottle neck of the bottle for lifting and pouring from the bottle by the handle.

16 Claims, 17 Drawing Sheets

BOTTLE OPENER AND STABILIZER

The present application is a non-provisional patent application that claims priority to U.S. Provisional Patent Ser. No. 62/526,163 filed on Jun. 28, 2017 and entitled: "Dual Bottle Opener and Holder;" the disclosure of which is incorporated herein in its entirety.

BACKGROUND

Opening bottles can be problematic for even those individuals with exceptional abilities. The bottle cap can be affixed to the bottle neck with too much force or the hands of the individual may be slightly wet such that a good grip cannot be obtained for removing the bottle cap. Additionally, many individual are elderly or have existing disabilities such that removing a bottle cap is nearly an impossible task.

One bottle that is particularly difficult to open and handle, in general, is a two-liter bottle. The bottle is unwieldy to pour from and can slip out of the firmest hands.

Existing bottle holders for two-liters lack an ability to assist in opening the bottle. Existing holders are also unstable such that a bottle tips from the weight of the holders when the bottle is nearly empty and lacks liquid weight to stabilize the bottle.

Furthermore, exiting bottle openers lack any ability of feature for holding the removed bottle cap and are usually designed only for assisting in removing the bottle cap.

Therefore, what is needed is a dual bottle opener and stabilizer that provides an improvement over what has heretofore been deficient in many aspects.

SUMMARY

In various embodiments, apparatuses are provided for a dual bottle cap remover and bottle stabilizer.

According to an embodiment, an apparatus includes a handle, a cap remover, and a bottle stabilizer. The cap remover is configured to engage a cap of a bottle and remove the cap when the apparatus as a whole is twisted. The bottle stabilizer is configured to securely engage a neck of the bottle and stabilize the bottle when the handle is lifted with the neck engaged in the bottle stabilizer and liquid is poured from the bottle.

DETAILED DESCRIPTION

Various perspective views of the dual bottle opener and stabilizer are presented in the FIGS. 1-17.

In an embodiment, the dual bottle opener and stabilizer includes two raised plastic bumps 133 proximate to a tip of the dual bottle opener and stabilizer 100, which steadies the bottle 200 when liquid is dispensed from the bottle 200 with the dual bottle opener and stabilizer 100.

Figure 1:
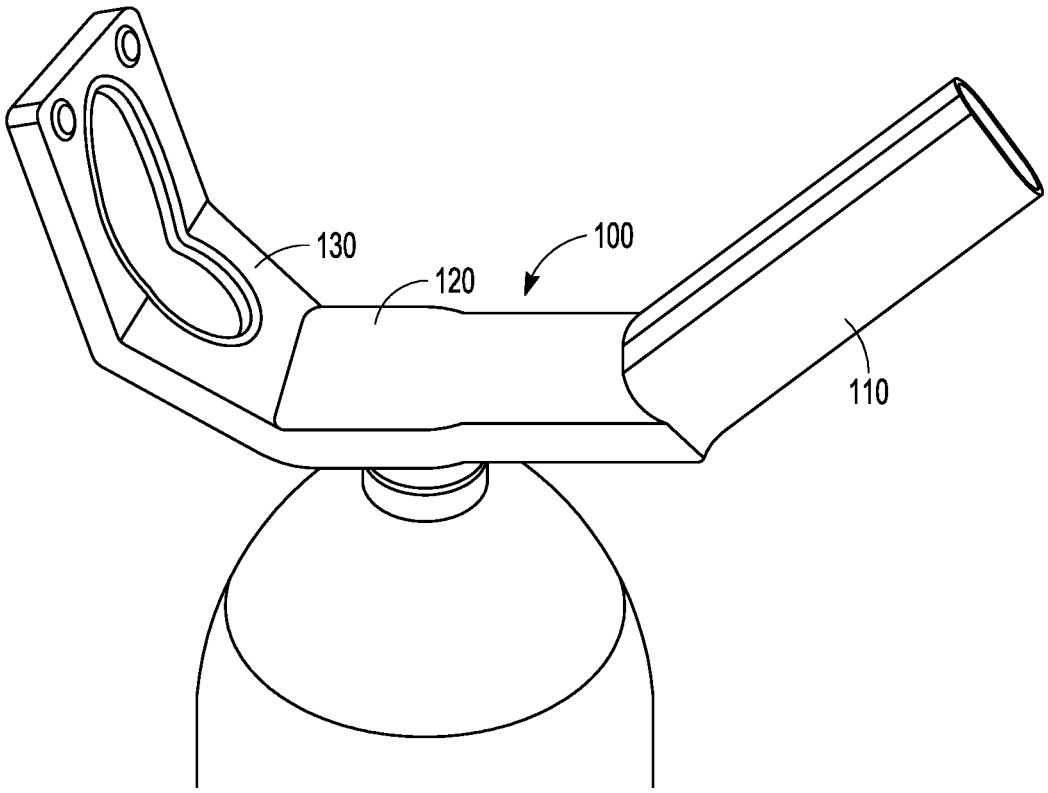
FIG. 1 illustrates a side perspective view of a dual bottle opener and stabilizer attached to a bottle cap of a bottle for removal of the cap, according to an example embodiment.
Figure 2:
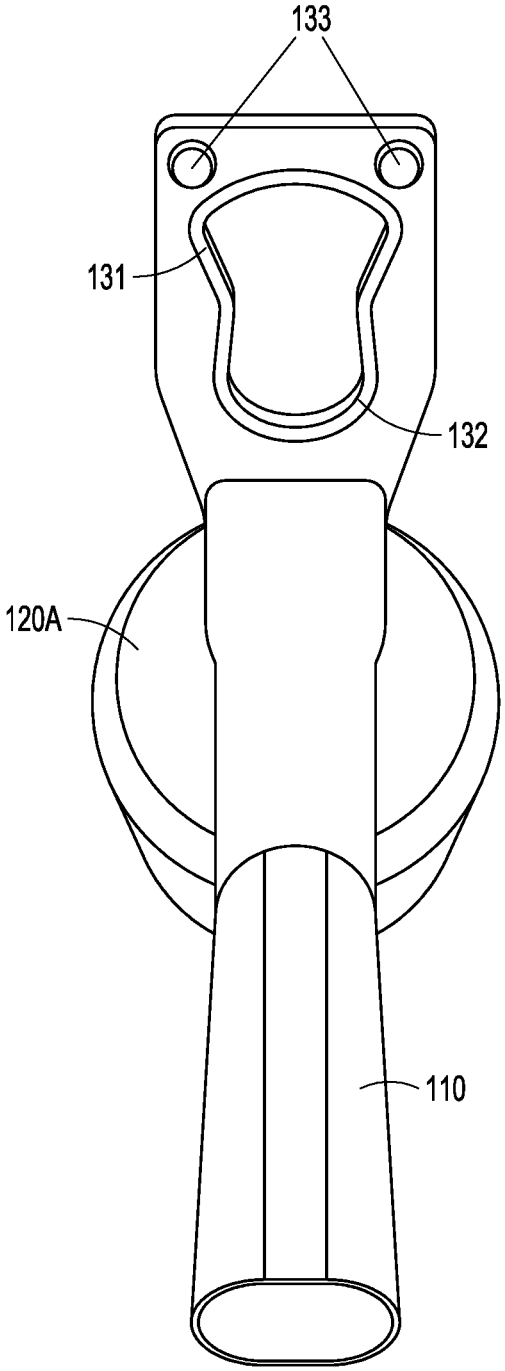
FIG. 2 illustrates a top perspective view of a dual bottle opener and stabilizer illustrating the cap removal apparatus, according to an example embodiment.
Figure 3:
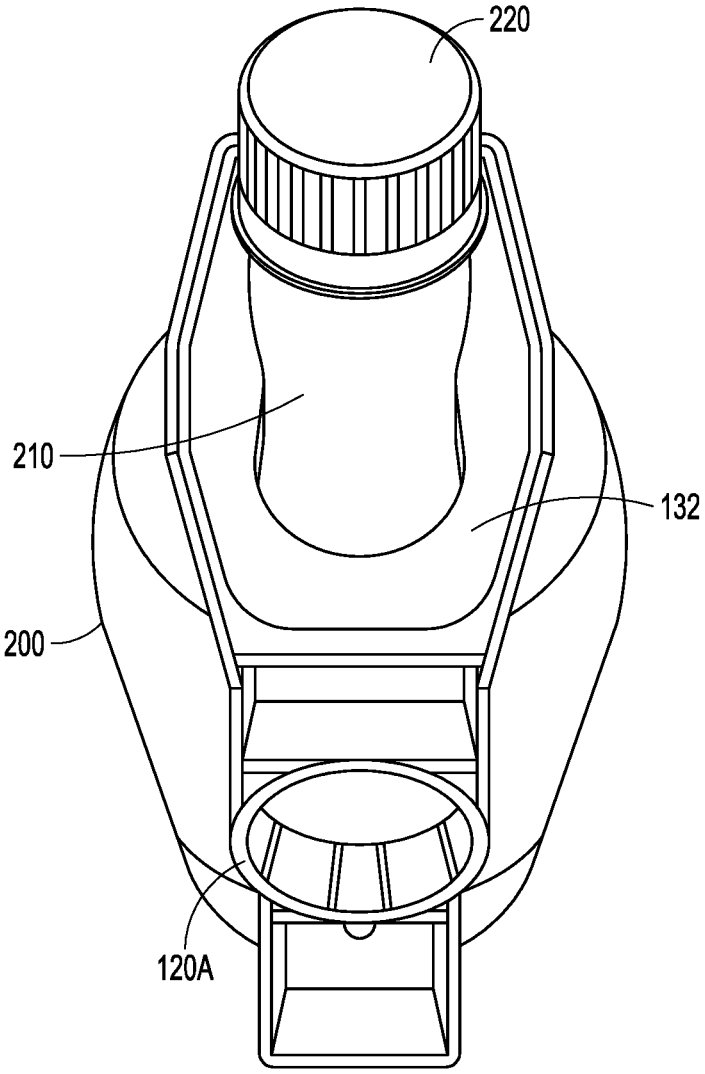
FIG. 3 illustrates a top and side perspective view of a dual bottle opener and stabilizer attached to a bottle neck of a bottle for holding the bottle and pouring from the bottle, according to an example embodiment.
Figure 4:
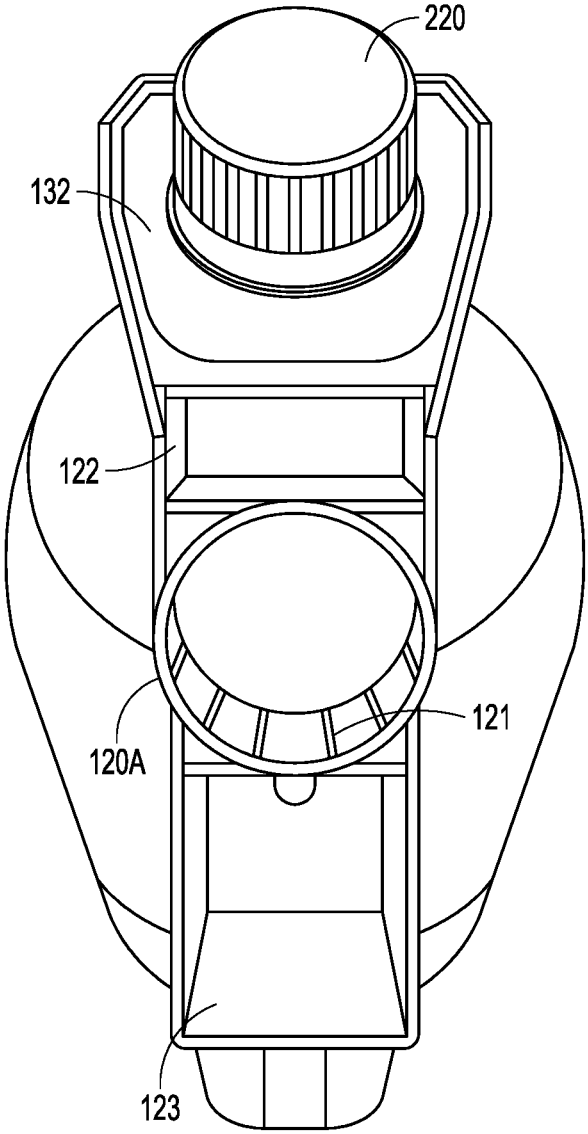
FIG. 4 illustrates another top and side perspective view of a dual bottle opener and stabilizer firmly attached to a bottle neck of a bottle for stabilizing the bottle and pouring from the bottle, according to an example embodiment.
Figure 5:
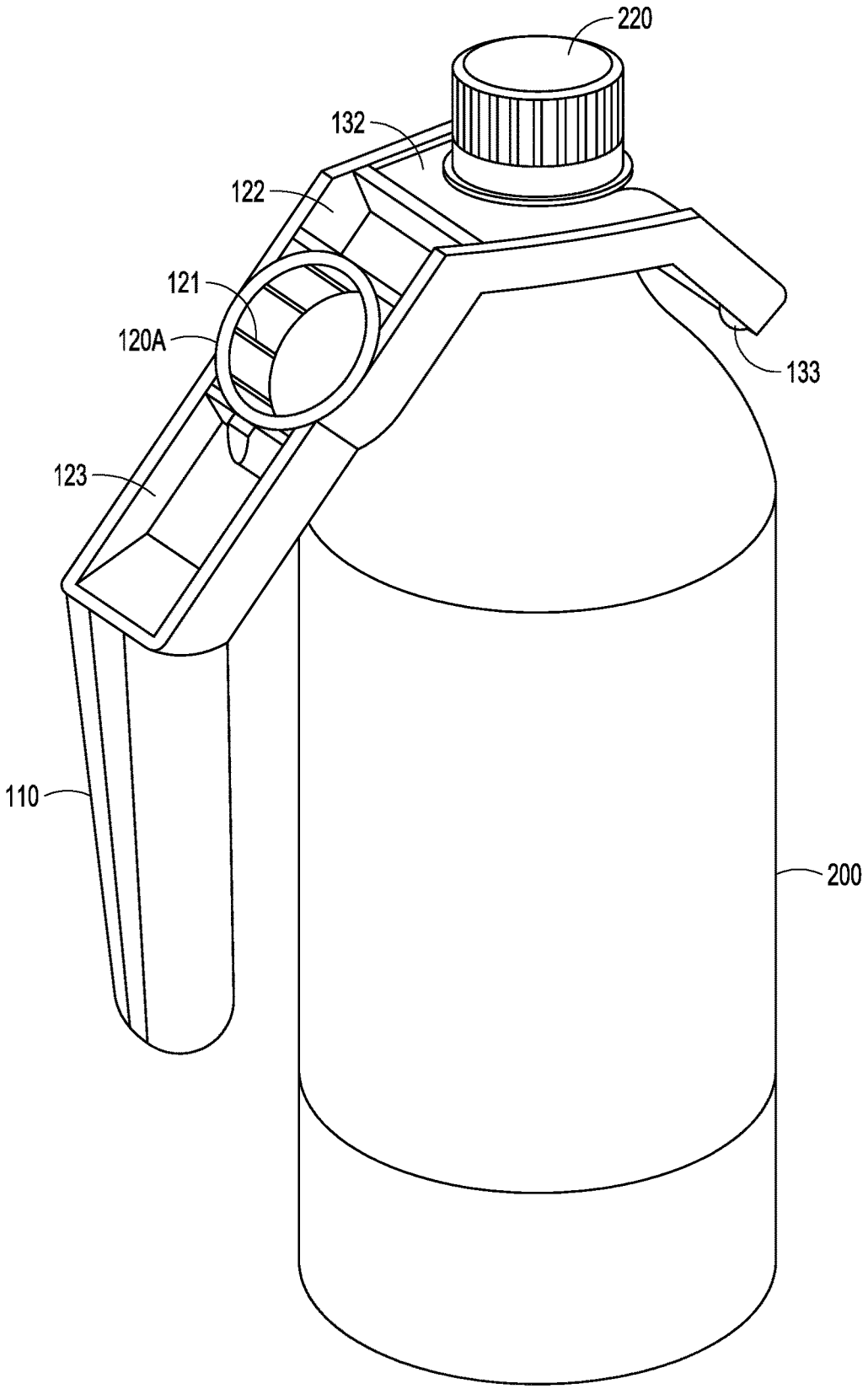
FIG. 5 illustrates a side perspective view of a dual bottle opener and stabilizer while the bottle is being held in a position permitting liquid in the bottle to be poured from the bottle, according to an example embodiment.
Figure 6:
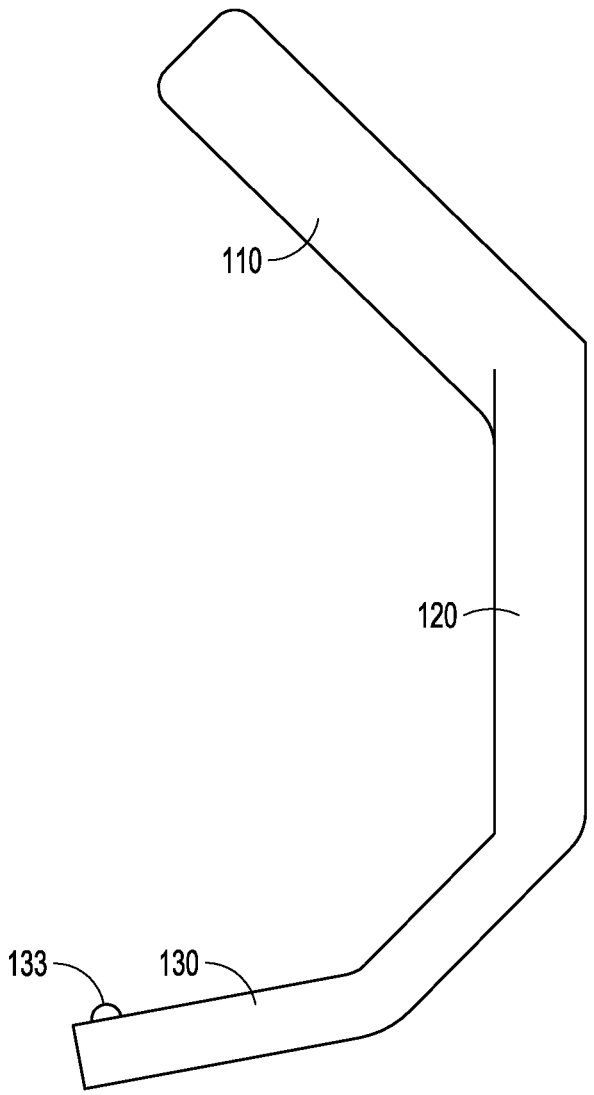
FIG. 6 illustrates a side perspective view of a dual bottle opener and stabilizer independently illustrated without any bottle, according to an example.
Figure 7:
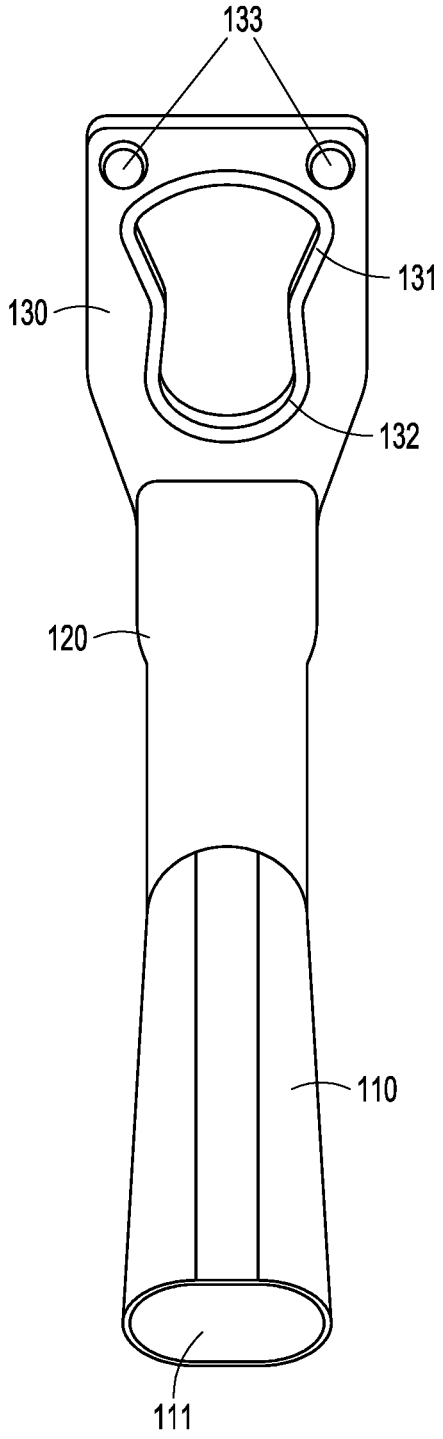
FIG. 7 illustrates a top perspective view of a dual bottle opener and stabilizer independently illustrated without any bottle, according to an example.
Figure 8:
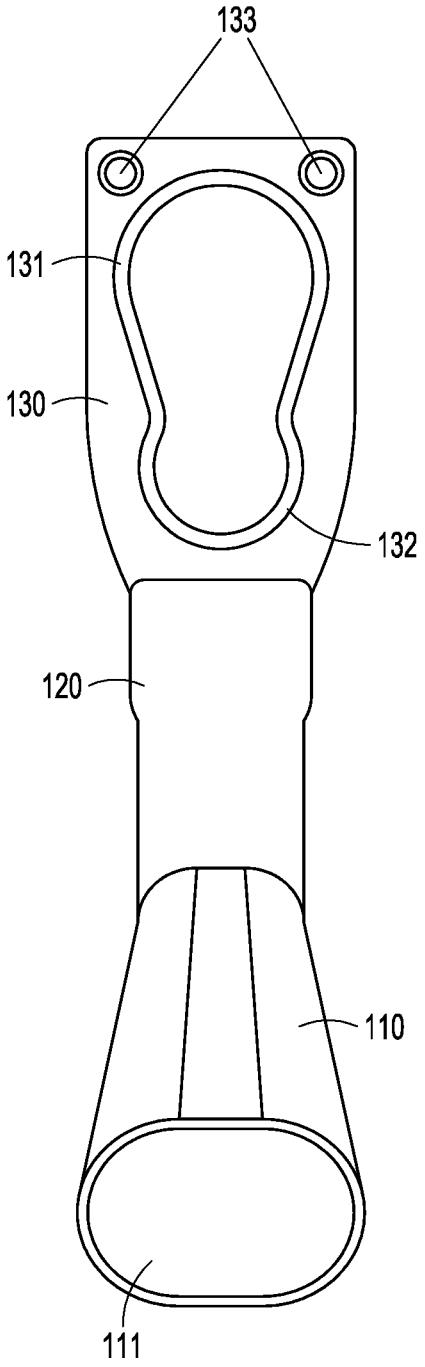
FIG. 8 illustrates a top and front perspective view of a dual bottle opener and stabilizer independently illustrated without any bottle, according to an example.
Figure 9:
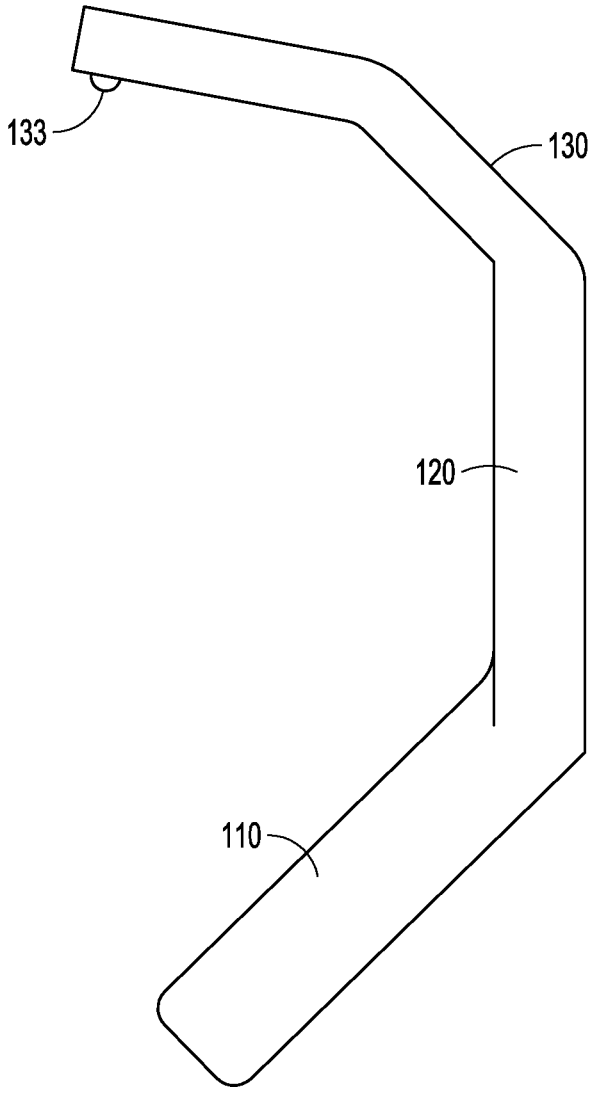
FIG. 9 illustrates another side perspective view of a dual bottle opener and stabilizer independently illustrated without any bottle, according to an example.
Figure 10:
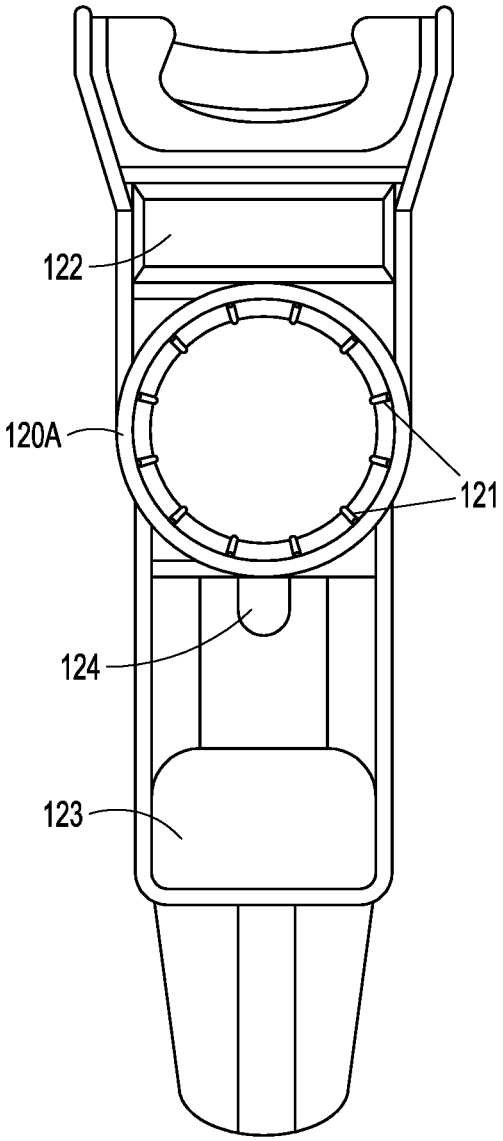
FIG. 10 illustrates another top and front perspective view of a dual bottle opener and stabilizer independently illustrated without any bottle and with the bottle opener and bottle cap holder illustrated, according to an example.
Figure 11:
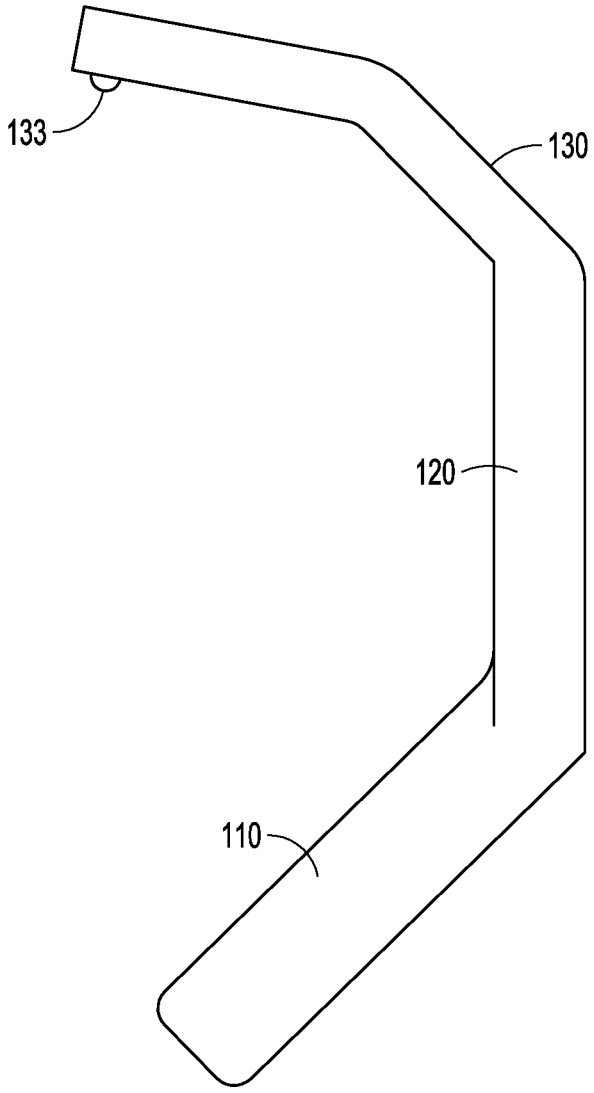
FIG. 11 illustrates still another side perspective view of a dual bottle opener and stabilizer independently illustrated without any bottle, according to an example.
Figure 12:
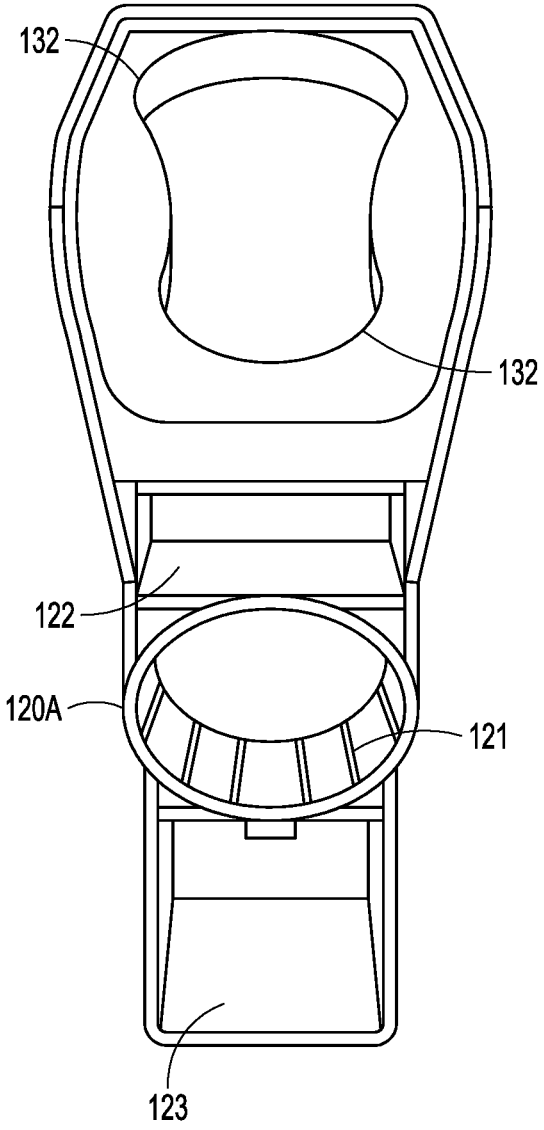
FIG. 12 illustrates another top perspective view of a dual bottle opener and stabilizer independently illustrated without any bottle and illustrating the bottle cap opener, holder, and neck attachment and stabilizing mechanism, according to an example.
Figure 13:
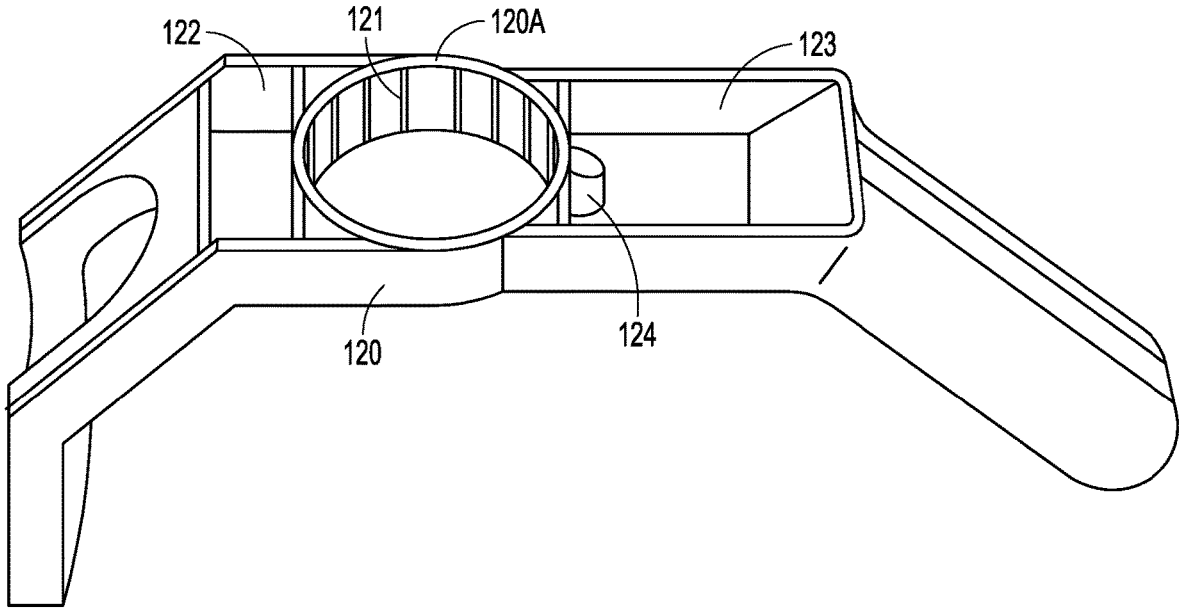
FIG. 13 illustrates a top perspective view of a dual bottle opener and stabilizer independently illustrated without any bottle and further illustrating the bottle cap opener, holder, and neck attachment/stabilizer, according to an example.
Figure 14:
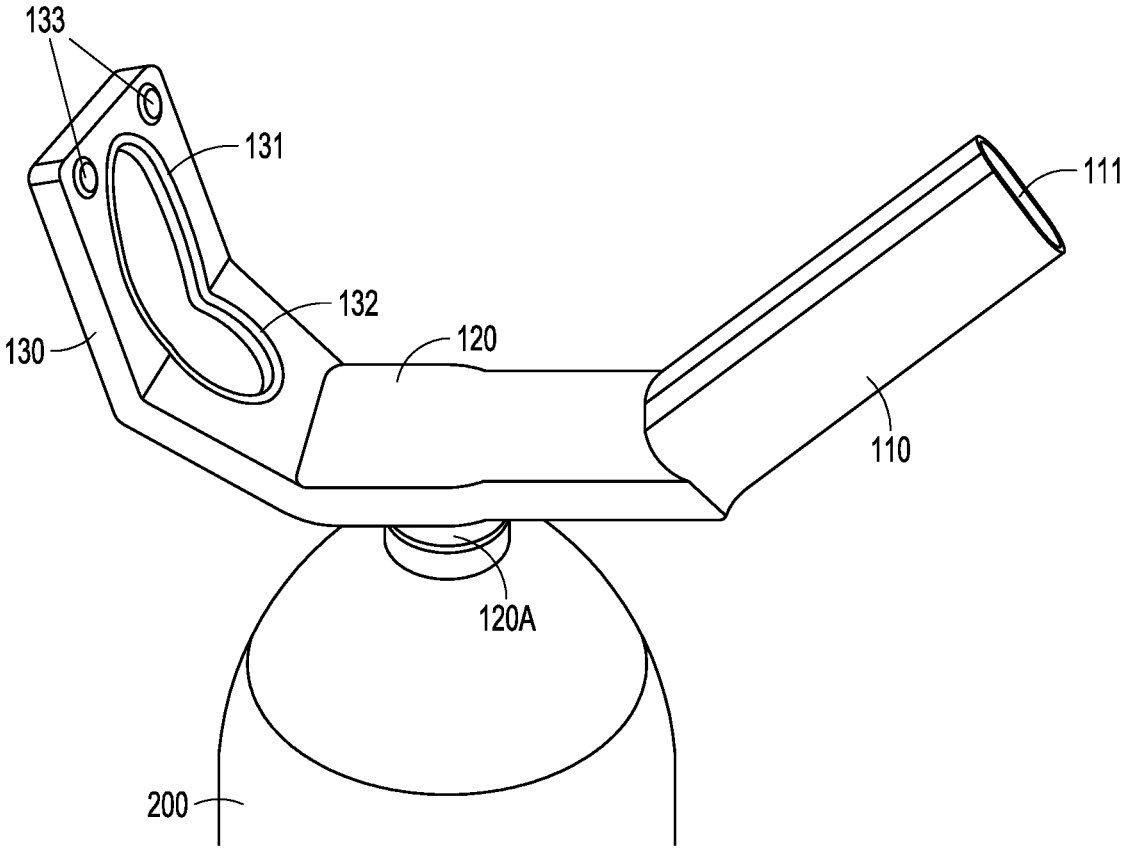
FIG. 14 illustrates a top perspective view of a dual bottle opener and stabilizer attached to a bottle cap of a bottle for removal of the cap, according to an example embodiment.

The configuration of the dual bottle opener and stabilizer 100 allows optimal leverage when the apparatus 100 is situated on the bottle 200 for removing the bottle cap 211 with a top surface 220 as illustrated in at least FIGS. 1, 2, and 14.

The dual bottle opener and stabilizer 100 is molded and sturdy single manufactured piece of plastic or plastic-based material.

The single manufactured piece of material includes three main sections: 1) a handle 110, 2) a dual bottle cap remover/holder 120, and 3) a bottle neck stabilizer 130.

In an embodiment, the total weight of the single manufactured piece of material is approximately 53 grams or 1.9 ounces.

In an embodiment, the dual bottle cap opener and stabilizer 100 is a single injection molded piece of sturdy plastic having three main sections.

Each section of the dual bottle cap opener and stabilizer 100 includes function with respect to: removing a cap 211 from a bottle 200, holding the cap 211, firmly engaging a neck 210 of the bottle 200, and lifting and pouring from the bottle 200.

The handle 110 is a formed as a hollow circular and rectangular cone 111 (with rounded smooth surfaces and corners) having an approximate length of 3.5 inches, a height of approximately $\frac{7}{8}^{th}$ of an inch, a width approximately $1\frac{3}{16}$ of an inch. The end of the handle 110 is molded next to the dual bottle cap remover/holder 120 at approximately a 140 degree angle from the underside surface of the dual bottle cap remover/holder 120.

Progressing from the handle 110 to the dual bottle cap remover/holder 120, the dual bottle cap remover/holder 120 includes three recessed areas on the top side; two of which (122 and 123) are optimally positioned and constructed for leverage, stability, and reduction in weight of the dual bottle opener and stabilizer 100. The stability and weight reduction assists in preventing an empty or almost empty two liter bottle 200 from tipping when the dual bottle opener and stabilizer 100 is affixed to the neck 210 of the two liter bottle 200.

The overall length of dual bottle cap remover/holder is approximately 3.25 inches, the width approximately $1\frac{3}{16}^{th}$ of an inch, and the height or depth approximately ½ of an inch.

The first recessed area 123 begins at the end of the handle 110 area is rectangular in shape having four sides. The side abutting the end of the handle 110 has a sloped recessed area that is sloped at an angle of approximately 110 degrees relative to the center of the first recessed area 123. The opposing side 120A to the side that abuts the handle 110 includes approximately $\frac{3}{16}^{th}$ of an inch of solid plastic protruding from a center of that side that abuts the second recessed area 120A, and is a solid formed plastic ridge that extends approximately $\frac{4}{16}^{th}$ of an inch from the side and extends from the bottom of the recessed area to the top with an approximate width of $\frac{5}{16}^{th}$ of an inch.

The second recessed area 120A is the recessed area that constructed as cap opener and holder apparatus. The second recessed area 120A is formed to snuggly fit on different sizes of two liter bottles (for instance Coke® and Pepsi® have different diameter sizes for their two liter bottles). The second recess area 120A is circular in shape having a diameter of approximately $1\frac{3}{16}^{th}$ of an inch, and the circumference of the recessed area is lined with small protruding ridges 121 with a total number of protruding ridges 121 being approximately 12 and each ridge evenly spaced along the circumference walls from one another (approximately $\frac{4}{16}^{th}$ to $\frac{5}{16}^{th}$ of an inch apart from one another. Each ridge 121 extends vertically from the bottom of the recessed area 120A to the top of the recessed area 120A and each ridge 121 approximately less than $\frac{1}{16}^{th}$ of an inch. The second recessed area 120A affixes and snaps onto the cap 211 of the bottle 210 and can also be used for storing the cap 211 while using the dual bottle opener and stabilizer 100 to pour liquid from the bottle 200.

Progressing from an end of the second recessed area 120A is the third recessed area 122. The side of the third recessed area 122 that abuts the start of component bottle neck stabilizer 130 creates a firm lip abutting the start of the bottle neck stabilizer 130. The lip is approximately $\frac{3}{16}^{th}$ of an inch shorter than the opposing side of the third recessed area 122 that abuts the end of the second recessed area 120A. The length of the third recessed area 122 is approximately $\frac{10}{16}^{th}$ of an inch, the height or depth is approximately ½ inch, and the width is approximately $1\frac{5}{16}^{th}$ of an inch.

The third section of dual bottle opener and stabilizer is the bottle neck stabilizer 130, which begins at the lip of third recessed area 122 from the dual bottle cap remover/holder 120. The bottle neck stabilizer 130 is formed at approximately a 140 degree angle to the underside of the dual bottle cap remover/holder 120. The bottle neck stabilizer 130 includes two portions, the first portion 132 begins at the end of dual bottle cap remover/holder 120 and extends for a length of $1\frac{12}{16}^{th}$ of an inch at which point portion the second portion 131 begins at an angle of approximately 140 degrees to the underside of portion two 132 and extends for a length of approximately two inches. The first portion 132 of the bottle neck stabilizer 130 is designed and constructed as a hole through which the neck 210 of a two liter bottle 210 can be firmly engaged or snapped into the hole having an approximate diameter for the first portion's recess of 1 inch. The second portion 131 is designed and constructed as a larger hole in the bottle neck stabilizer 130 over which the bottle cap 210 can fit through for purposes of engaging and snuggly coupling the neck 210 of the bottle 200 into the first portion 132 of the bottle neck stabilizer 130 and has an approximate average diameter of 1½ inches. The underside and end of the second portion 131 of the bottle neck stabilizer 130 includes two raised solid plastic bumps 133 on opposing sides of the second portion 131 for engaging with an outer surface of the bottle 200 when the bottle neck 210 is engaged in the first portion 132 of the bottle neck stabilizer 130. The bumps 133 assist in steadying the bottle 200 when the dual bottle opener and stabilizer 100 is engaged for pouring liquid from the bottle 200.

The second portion 131 of the bottle neck stabilizer 100 is positioned over the neck 210 of a bottle 200 and the dual bottle opener and stabilizer 100 is lowered down onto the bottle 200 with the neck 210 extending through the second portion 131. The dual bottle opener and stabilizer 100 is then moved forward (in the direction of the first portion 132) to snap the neck 210 into the recessed area of the first portion 132. When the dual bottle opener and stabilizer 100 remains at rest and is not being actively lifted for pouring from the bottle, the recessed area 131, the bumps 133, and the handle 110 do not engage or touch any surface of the bottle 200 (as illustrated in the FIG. 16). The handle 110 is then lifted (as illustrated in FIG. 17) and the raised bumps 133 engage the surface of the bottle 200 for support and stabilization when pouring liquid from the bottle 200.

Figure 15:
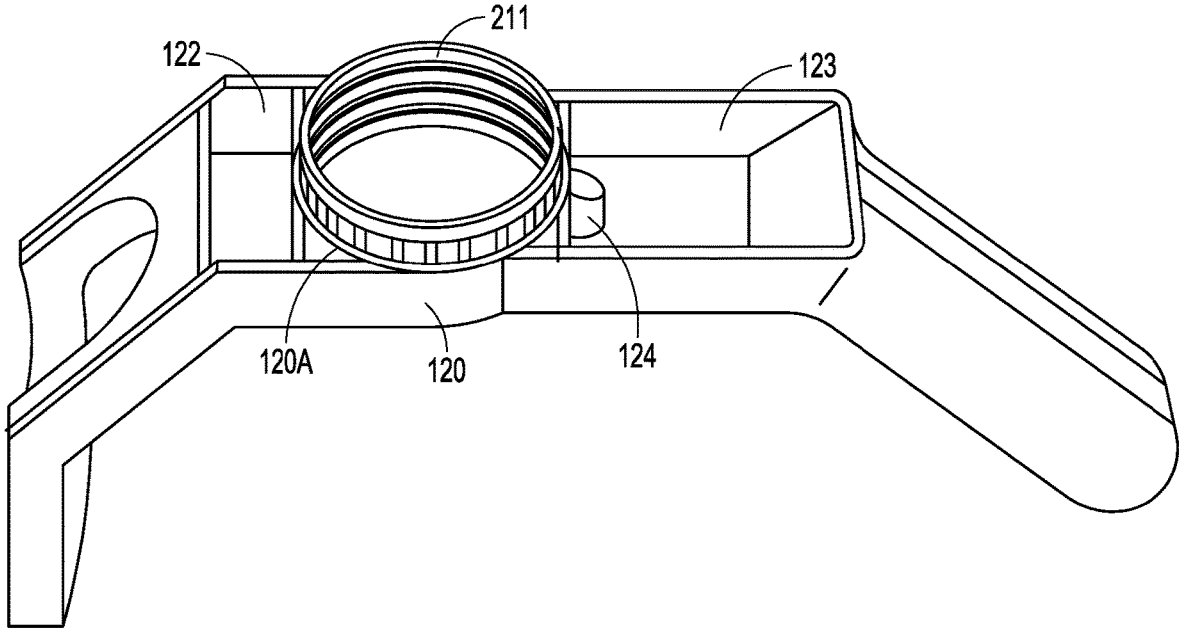
FIG. 15 illustrates an underside perspective view of a dual bottle opener and stabilizer where a cap is placed in the bottle cap holder, according to an example embodiment.
Figure 16:
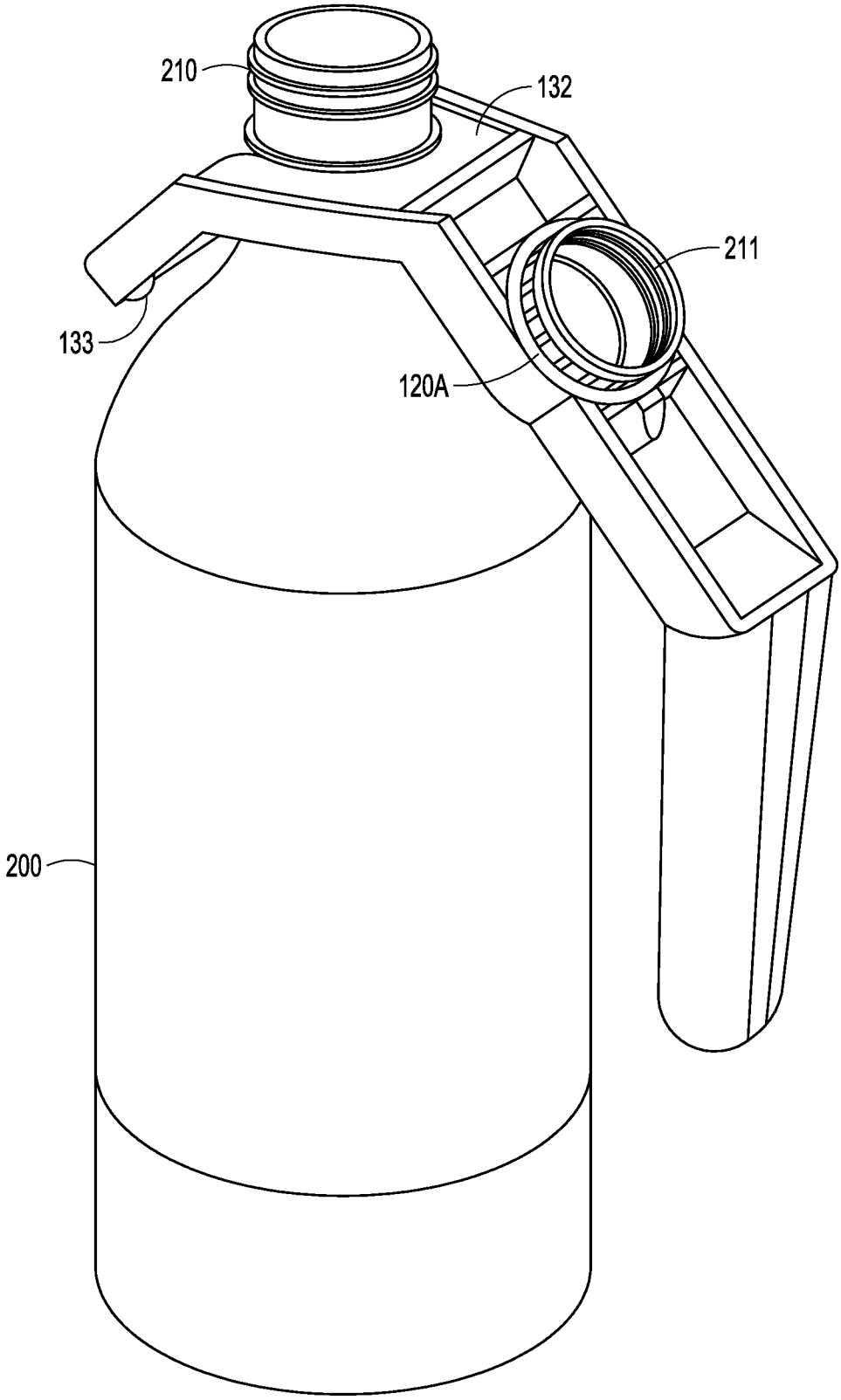
FIG. 16 illustrates a side perspective view of a dual bottle opener and stabilizer where a cap is placed in the bottle cap holder while the dual bottle opener and stabilizer is affixed to the bottle neck, according to an example embodiment.
Figure 17:
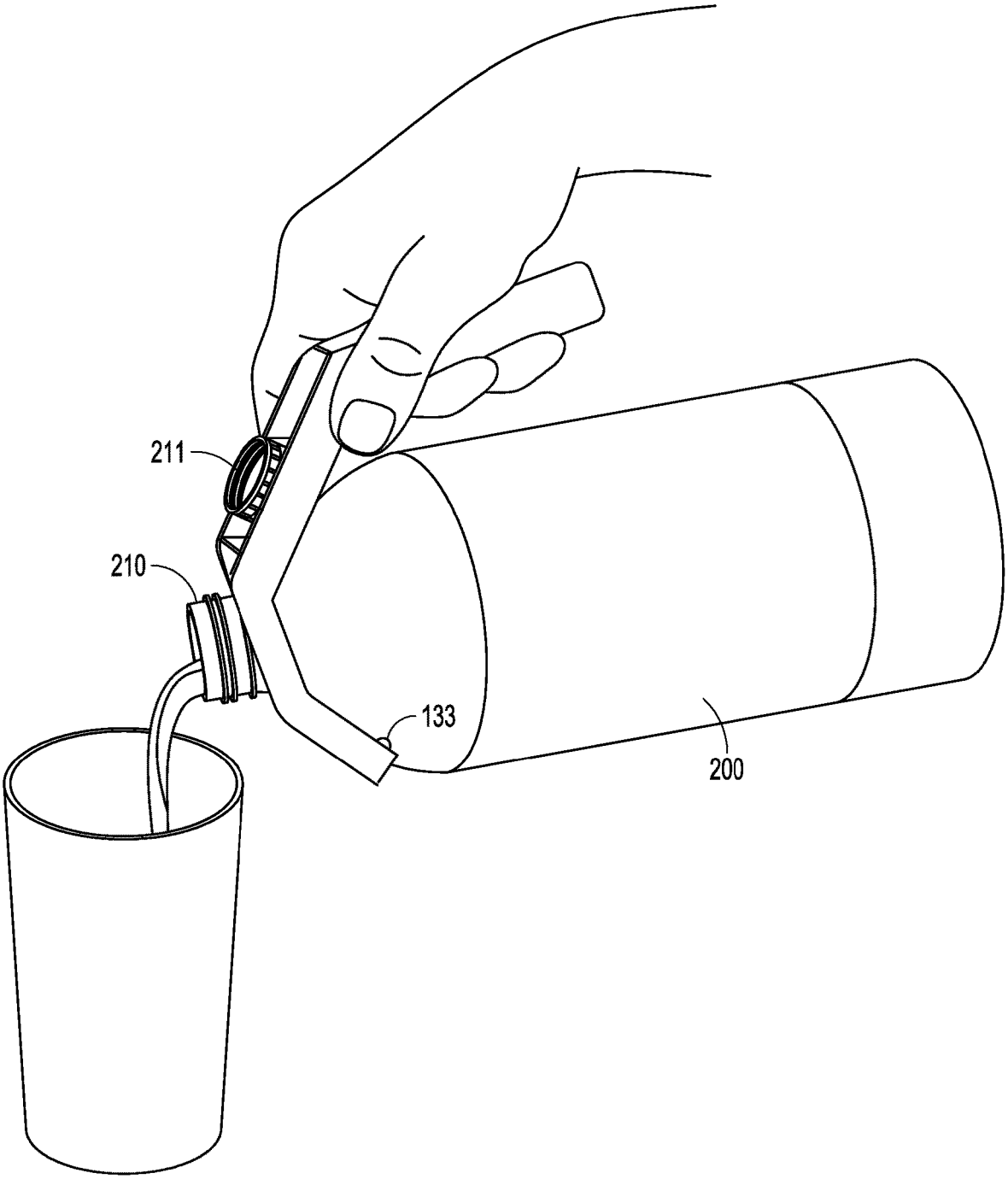
FIG. 17 illustrates a side perspective view of a dual bottle opener and stabilizer where a cap is placed in the bottle cap holder while the dual bottle opener and stabilizer is affixed to the bottle neck and liquid is being poured from the bottle using the dual bottle opener and stabilizer, according to an example embodiment

The cap 211 when removed from the bottle 200 fits snuggly into the bottle holder/remover 120A as illustrated in the FIGS. 15-17. The second recessed area 120A is constructed to engage caps 211 and remove the caps 211 when the dual bottle opener and stabilizer 100 is twisted in a direct that removes the caps 211 (typically moved in a counter clockwise direction). The same second recessed area 120A holds the removed cap 211. The ridges 121 provide firm resistance against the cap 211 to prevent the second recessed area 120A from sliding along the outer surface of the cap 211. The ridges 121 also provide stabilization for holding any removed cap 211.

During removal of a cap 211, one hand of the user is used to stabilize the bottle 200 while the other hand twists the dual bottle cap opener and stabilizer 100 is a counter clockwise direction. The cap 211 remains lodged and held in the second recessed area 120A when the dual bottle cap opener and stabilizer 100 is lifted vertically up from the bottle 200. The user then turns the dual bottle cap opener and stabilizer 100 over and places recessed area 131 over the bottle neck 210 and snaps the neck 210 into the recessed area 132. The cap remains in the recessed area 120A when the dual bottle opener and stabilizer 100 is lifted vertically and tilted forward in a horizontal direction, at which point the bumps 133 engage an outer surface of the bottle 200 providing stabilization during pouring (see FIGS. 16-17).

In an embodiment, the dual bottle cap remover/holder 120A includes a small manufactured plastic ridge 124 (as shown in the FIGS. 10, 13, and 15) that extends from the centered recessed area 120A into the first recessed area 123. This provides further balance and weight distribution when operating the dual bottle cap opener and stabilizer 100.

In an embodiment, the handle 110, the dual bottle cap remover/holder 120A, and the bottle neck stabilizer 130 are configured with different dimensions as a single molded apparatus for wine bottles or for bottle caps of different dimensions.

The invention claimed is:

1. An apparatus, comprising:

a first section defining a handle configured to lift a bottle when a bottle neck is snapped into the apparatus;

a second section coupled on a first side to the first section and defining a dual bottle cap remover and holder configured to engage and remove a cap of the bottle and hold the cap in the second section when the apparatus is moved from a cap removal orientation to a bottle pouring orientation;

a third section extending from a second side of the second section and defining a bottle stabilizer configured to engage the bottle neck when the apparatus is in the bottle pouring orientation, and further configured to stabilize the bottle when the first section is lifted and a liquid is poured from the bottle;

a pair of stabilizing members proximate to a tip of the third section;

wherein the pair of stabilizing members are raised bumps that engage a surface of the bottle while the liquid is poured from the bottle to provide bottle stability during pouring of the liquid; and wherein the second section further comprises three recessed areas along a longitudinal axis, a first one of the recessed areas sized to fit over the cap and adapted to engage the cap and remove the cap when the apparatus is twisted and the apparatus is in the cap removal orientation and hold the cap when the apparatus is in the bottle pouring orientation, a second one and a third one of the recessed areas, each on either side of the first one of the recessed area along said axis, reduces a weight of the apparatus and provides balance to ensure that the bottle when empty does not tip over while the third section is engaged with the bottle neck of the bottle by distributing an apparatus weight for the apparatus.

2. The apparatus of claim 1, wherein the cap remover is further configured to firmly hold the cap once removed from the bottle.

3. The apparatus of claim 2, wherein the apparatus is in a first orientation with respect to the bottle during removal of the cap and in an opposite orientation when the liquid is poured from the bottle, and wherein the cap remains firmly held in the cap remover while the apparatus is in the opposite orientation.

4. The apparatus of claim 1, wherein the handle is a hollow rectangular cone of plastic material.

5. The apparatus of claim 4, wherein the rectangular cone has a diameter of approximately 1 3/16 of an inch.

6. The apparatus of claim 5, wherein an inner circumference surface of the rectangular cone includes protruding ridges evenly spaced from one another along the inner circumference surface.

7. The apparatus of claim 6, wherein each ridge is approximately 4/16 to 5/16 of an inch from an adjacent ridge.

8. The apparatus of claim 7, wherein each ridge is approximately less than 1/16 of an inch.

9. The apparatus of claim 1, wherein the handle and the bottle stabilizer extend at an angle from opposing ends of the cap remover to form the apparatus.

10. The apparatus of claim 9, wherein the apparatus is a single piece of injection molded plastic.

11. The apparatus of claim 1, wherein the bottle stabilizer includes two holed areas with a first holed area configured to fit over the neck of the bottle, and the second holed area configured to snap onto and hold the neck when the apparatus is moved with the neck of the bottle in the first holed area towards the second holed area.

12. The apparatus of claim 11, wherein the second holed area has a diameter of approximately 1 inch and the first holed area has a diameter of approximately 1% of an inch.

13. The apparatus of claim 1, wherein the bottle stabilizer extends from a first side of the dual bottle cap remover and holder at approximately 140 degree angle to an underside surface of the dual bottle cap remover and holder relative to an orientation of the apparatus when the dual bottle cap remover and holder is engaged with the cap for removal of the cap from the bottle.

14. The apparatus of claim 13, wherein the handle extends from an opposing and second side of the dual bottle cap remover and holder at approximately 140 degree angle to the underside surface of the dual bottle cap remover and holder relative to the orientation of the apparatus when the dual bottle cap remover and holder is engaged with the cap for removal of the cap from the bottle.

15. The apparatus of claim 1, wherein the apparatus is manufactured as a single piece of injection molded plastic material comprising the first section, the second section, and the third section.

16. The apparatus of claim 15, wherein the second section extends from the first section at an angle of approximately 140 degrees relative to an underside surface of the first section when the apparatus is in the cap removal orientation, and wherein the third section extends from the first section at an angle of approximately 140 degrees relative to the underside surface of the first section when the apparatus is in the cap removal orientation.

* * * * *